US010583318B2

(12) United States Patent
Nalley

(10) Patent No.: US 10,583,318 B2
(45) Date of Patent: Mar. 10, 2020

(54) DUMBBELL WEIGHT TRAINING DEVICE HAVING SELECTIVELY CONNECTED WEIGHT PLATES

(71) Applicant: Mark Nalley, Murrieta, CA (US)

(72) Inventor: Mark Nalley, Murrieta, CA (US)

( * ) Notice: Subject to any disclaimer, the term of this patent is extended or adjusted under 35 U.S.C. 154(b) by 94 days.

(21) Appl. No.: 15/944,434

(22) Filed: Apr. 3, 2018

(65) Prior Publication Data

US 2019/0299047 A1 Oct. 3, 2019

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0004; A63B 21/00058–00065; A63B 21/00069; A63B 21/0601–0604; A63B 21/072–075; A63B 21/4035; A63B 2210/00; A63B 2210/50; A63B 2244/09
See application file for complete search history.

(56) References Cited

U.S. PATENT DOCUMENTS 3,572,702 A * 3/1971 Dorn ..... A63B 21/0603 482/106
7,588,520 B2 9/2009 Nalley
8,075,458 B2 12/2011 Nalley
8,206,274 B2 * 6/2012 Svenberg ..... A63B 21/063 482/104

* cited by examiner

*Primary Examiner* — Megan Anderson
*Assistant Examiner* — Kathleen Vermillera
(74) *Attorney, Agent, or Firm* — Morland C. Fischer

(57) ABSTRACT

A dumbbell to be used as a weight training device during an exercise program. The dumbbell includes a gripping handle and a pair of collars connected to opposite ends of the handle. A series of weight plates having different weights are selectively and detachably connected to each other and to the pair of the collars so as to enable a user to incrementally adjust the gross weight of the dumbbell to conform to his exercise program. Each weight plate has a recessed V-shaped coupling slot formed in one face thereof and a V-shaped coupling body projecting from the opposite face. The V-shaped coupling body of a first weight plate being carried by the dumbbell is aligned with and guided into receipt by the V-shaped coupling slot of an adjacent additional weight plate so that the first and additional weight plates can be detachably connected together.

12 Claims, 7 Drawing Sheets

DUMBBELL WEIGHT TRAINING DEVICE HAVING SELECTIVELY CONNECTED WEIGHT PLATES

BACKGROUND OF THE INVENTION

1. Field of the Invention

This invention relates to a versatile dumbbell of the type commonly found in a fitness center to be used as a weight training device. The dumbbell is adapted to carry a set of weight plates that are detachably and selectively connected to one another by means of operating locking switches associated with respective ones of the weight plates so that the gross weight of the dumbbell can be incrementally varied and thereby tailored to fit a weight training program of the user.

2. Background Art

A dumbbell is a weight training device that has long been used by body builders and exercise conscious individuals to improve their physical strength and appearance as part of a weight training program. Such a dumbbell typically includes a cylindrical gripping handle that carries a pair of weight plates at opposite ends thereof. In this regard, the weight plates are fixedly connected to the ends of the gripping handle. Should the user wish to increase the weight to be lifted, he must find an altogether different dumbbell. In other words, there is no easy way for the user to selectively adjust or progressively change the weight of a conventional dumbbell to be used during a workout, such that the gross weight of the dumbbell remains the same at all times.

As a consequence of the foregoing, the fitness center or the user (should he elect to exercise at his home, office or elsewhere) must maintain many different dumbbells having different gross weights. Accordingly, the cost to acquire a variety of dumbbells and the space consumed as a result thereof are undesirably increased. Moreover, the user's ability to easily and quickly expand his personal weight training program is hampered by the requirement to have ready access to such different dumbbells.

One example of an improved easy-to-use dumbbell which overcomes the aforementioned problem is available by referring to my U.S. Pat. No. 7,588,520 issued Sep. 15, 2009. My patent discloses a dumbbell including a plurality of weight plates having respective locking cartridges that are selectively operated to connect weight plates having different weights to one another to thereby change the gross weight carried by the dumbbell.

Nevertheless, what is now desirable is to improve my patented dumbbell by simplifying a user's ability to select a particular one of the plurality of weight plates having different weights and detachably connect (or disconnect) the selected weight plate to or from an adjacent weight plate so that the gross weight of the dumbbell may be accurately and progressively varied to conform to the weight training program of the user.

SUMMARY OF THE INVENTION

In general terms, an improved dumbbell is disclosed of the kind that is typically found in a fitness center to be used as a weight training device. The present improvement advantageously permits a user to quickly and easily vary the gross weight of a single dumbbell by adding or removing different weight plates having correspondingly different weights. To this end, the weight plates are preferably manufactured from metal and have a uniform size, thickness and (e.g., disc-like) shape. Each weight plate has a pair of filling cavities that can be filled with steel plugs to increase the weight thereof. In the alternative, the filling cavities can be left empty by which the weight of the weight plate is reduced.

The dumbbell includes a pair of disc-like collars connected to opposite ends of a cylindrical gripping handle. One or more weight plates are detachably connected to each other and to the pair of collars. Each weight plate has opposing inside and outside faces. A V-shaped coupling slot is recessed into the inside face of each weight plate, and a V-shaped coupling body extends from the outside face of each weight plate opposite the coupling slot. The coupling slot at the inside face of an additional weight plate to be added to the dumbbell to increase the weight thereof is sized and shaped to slideably receive therewithin the coupling body at the outside face of an existing weight plate being carried by the dumbbell such that the additional and existing weight plates are detachably connected together so as to lie face-to-face one another. By virtue of their gradually widening shapes, the V-shaped coupling body of the existing weight plate is automatically guided into alignment with and receipt by the V-shaped coupling slot of the additional weight plate so as to be quickly and easily connected thereto or disconnected therefrom.

A locking cartridge is located within a cartridge cavity that extends through each weight plate. The locking cartridge received within the cartridge cavity of the additional weight plate includes a locking pin and a switch knob that is coupled to the locking pin by way of a rotatable toggle lever switch arm. A pushing force applied by a finger of the user in a first direction to the switch knob causes the switch arm to rotate and the locking pin to be moved thereby through the locking cartridge of the additional weight plate from a retracted position to an extended position outwardly from the locking cartridge. In its extended position, the locking pin rides through a coupling channel that runs laterally through the coupling body of the existing weight plate. The receipt of the locking pin through the coupling channel prevents a separation of the coupling body of the existing weight plate from the coupling slot of the additional weight plate, whereby the additional weight plate is detachably connected face-to-face to the existing weight plate to increase the weight of the dumbbell.

A pulling force applied by the user's finger in an opposite direction to the switch knob causes the switch arm to rotate and the locking pin of the locking cartridge of the additional weight plate to move from its extended position to a retracted position inwardly of the locking cartridge so as to ride out of the locking channel in the coupling body of the existing weight plate. Accordingly, the V-shaped coupling body of the existing weight plate can now be easily pulled out of and separated from the V-shaped coupling slot of the additional weight plate, whereby the existing weight plate is disconnected from the additional weight plate.

In order for the user's finger to be able to distinguish one switch knob from another and fully engage and push or pull the particular switch knob of the locking cartridge of the additional weight plate in opposite directions as is required to reliably connect or disconnect the existing weight plate to or from the additional weight plate of the dumbbell, the switch knob rotates along a path that conforms to the arc of a circle and coincides with the circumference of the additional disc-like weight plate. The foregoing is achieved by means of a coupling tab that depends from the switch knob and slides up or down over the rotatable switch arm as the switch knob and the switch arm move back and forth with one another.

DESCRIPTION OF THE PREFERRED EMBODIMENT

Figure 1:
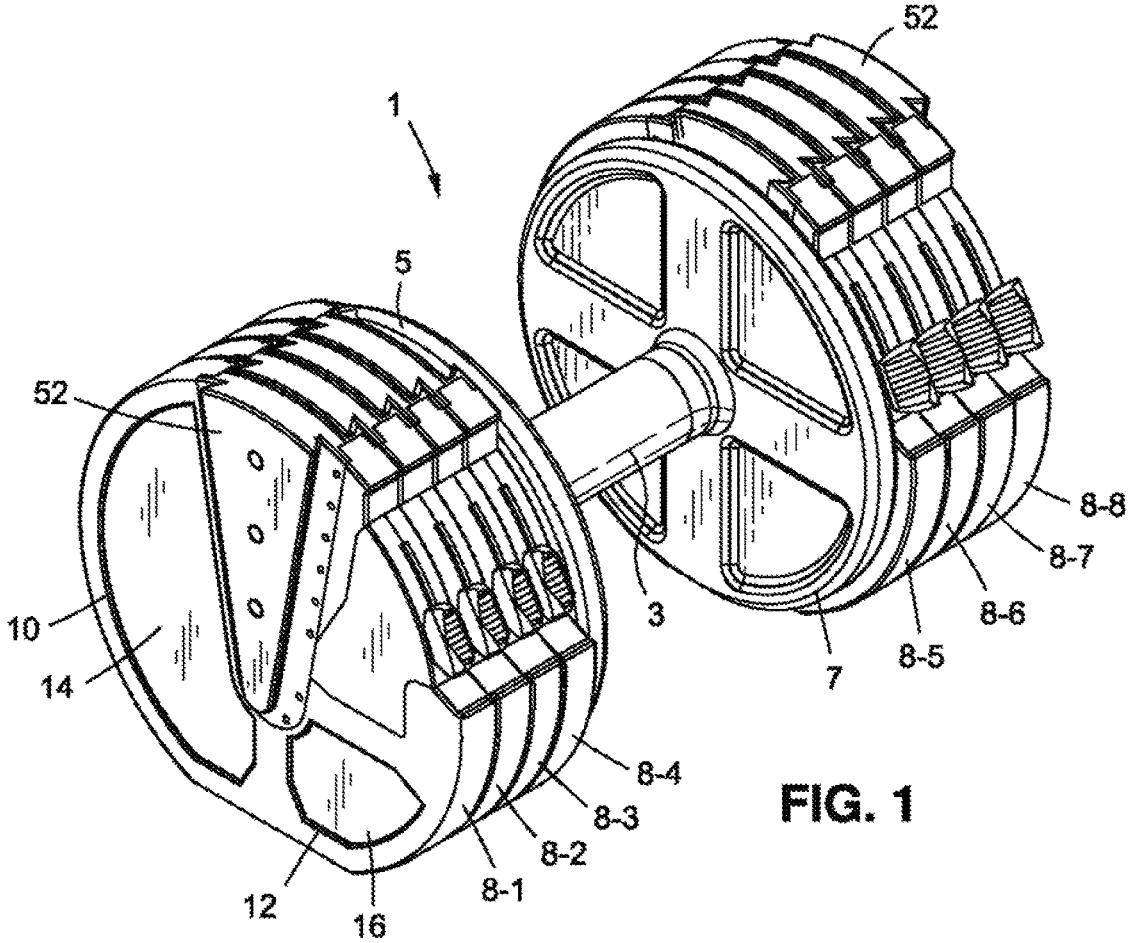
FIGS. 1 and 2 are perspective views illustrating an adjustable weight dumbbell having a plurality of weight plates that have different weights and are adapted to be selectively and detachably connected face-to-face one another at opposite ends of a gripping handle to change the gross weight of the dumbbell.
Figure 2:
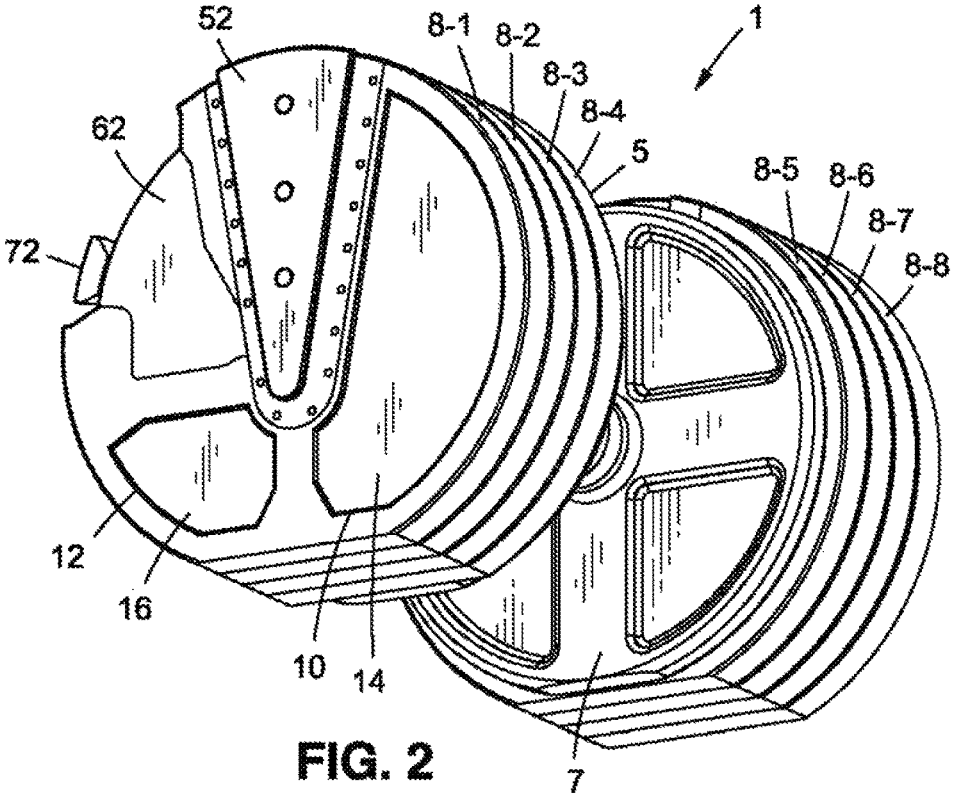
Figures 3, 4:
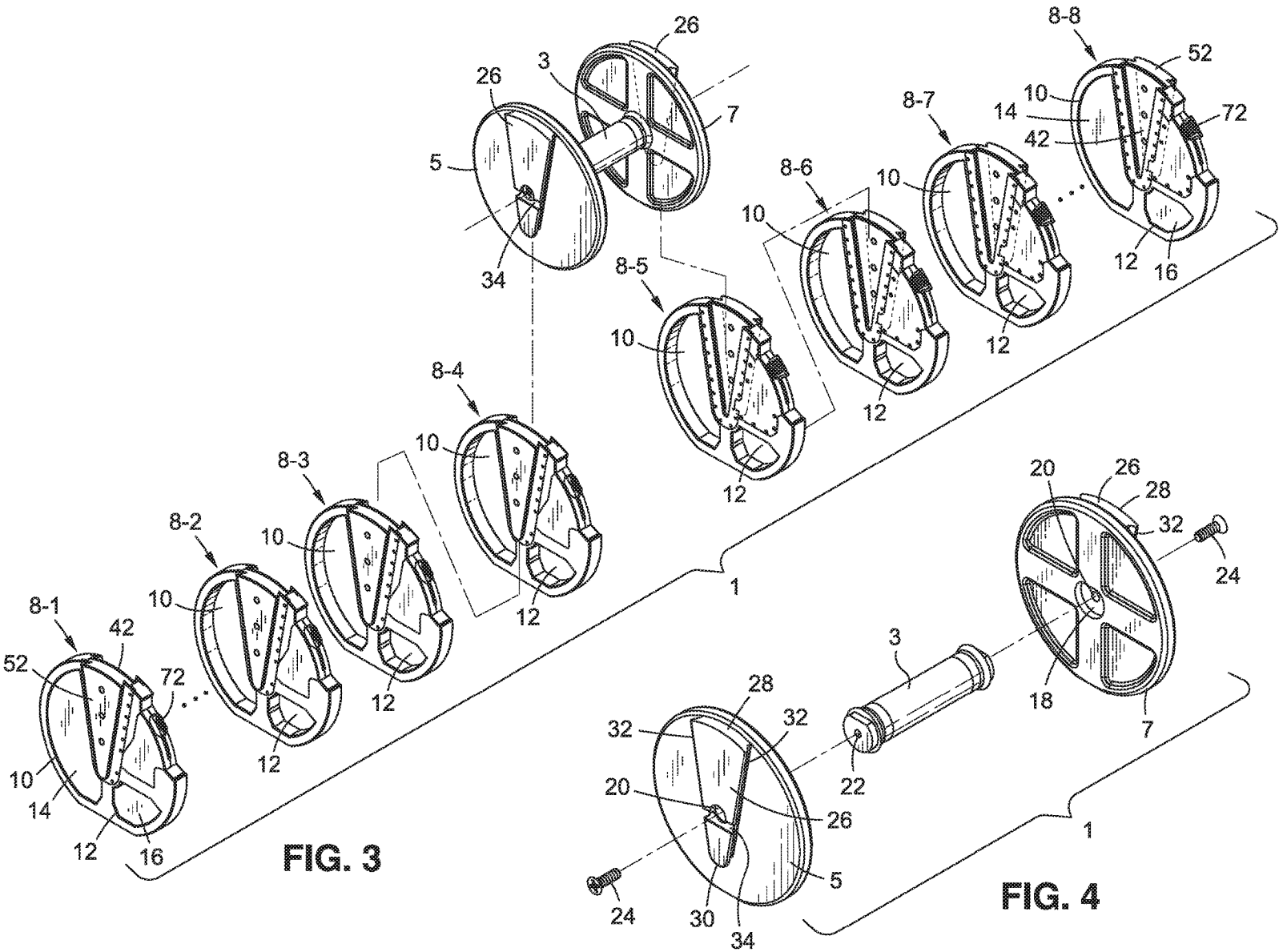
FIG. 3 is an exploded view of the dumbbell shown in FIGS. 1 and 2.
FIG. 4 is an exploded view of the dumbbell shown in FIG. 3 with the weight plates removed therefrom.
Figure 8:
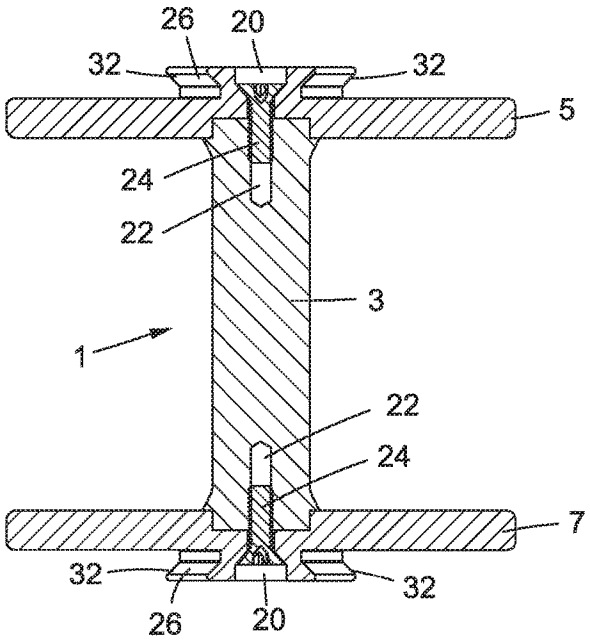
FIG. 8 is a cross-section of the dumbbell shown in FIG. 4 taken along lines 8-8 of FIG. 7.
Figure 7:
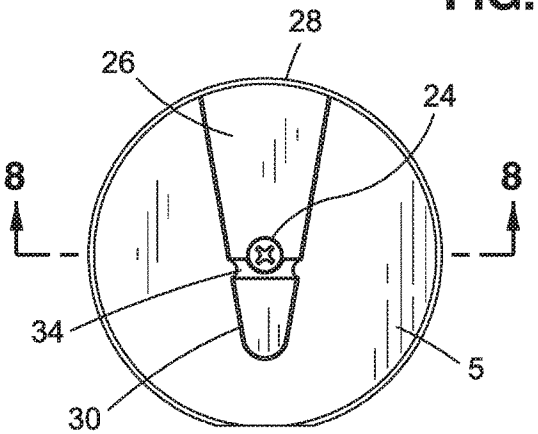
FIG. 7 is an end view of the dumbbell shown in FIG. 4.
Figure 5:
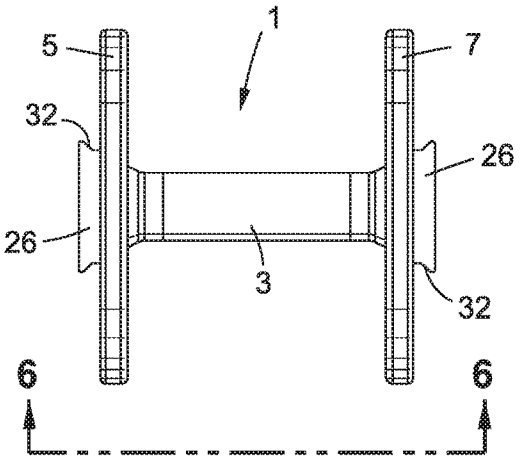
FIG. 5 is a top view of the dumbbell shown in FIG. 4.
Figure 6:
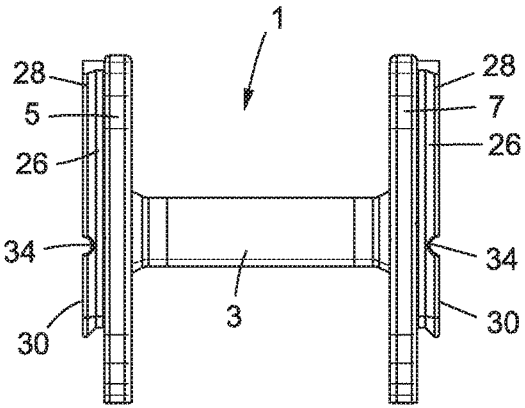
FIG. 6 is a side view of the dumbbell shown in FIG. 4 as viewed in the direction of lines 6-6 of FIG. 5.

Referring initially to FIGS. 1-3 of the drawings, there is shown a versatile dumbbell 1 of the type to be used as a personal exercise and weight training device. Thus, the dumbbell 1 will be typically found at a fitness center or at home to be repeatedly lifted by one seeking to improve his physical appearance, strength and conditioning. Although it is contemplated that the dumbbell 1 shown in FIGS. 1-3 will be grasped in a single hand of a user, the teachings of this invention are also applicable to a larger bar bell device of the type to be grasped and lifted with both hands of the user.

The dumbbell 1 has a cylindrical gripping handle 3 that extends between and is connected to opposing disc-like collars 5 and 7 (best shown in FIG. 3). The handle 3 is sized to be gripped within a single hand of a user. In the event that the teachings of this invention are applied to a bar bell, the length of handle 3 will be extended to accommodate both hands of the user. A variable number of (e.g., eight) identical weight plates designated 8-1 . . . 8-8 can be detachably connected to each other and to the collars 5 and 7 at opposite ends of the gripping handle 3 depending upon the experience of the user and the weight lifting exercise in which he will be engaged. During use of the dumbbell 1, a first set consisting of half of the desired number of weight plates (e.g., 8-1 . . . 8-4) is coupled to one of the collars 5, and a second set consisting of the remaining number of weight plates (e.g., 8-5 . . . 8-8) is coupled to the other collar 7. By virtue of being able to vary the number of weight plates 8-1 . . . 8-8 to be carried by dumbbell 1, the gross weight of the dumbbell can be selectively and incrementally changed so as to be tailored to conform to the weight training program of the user.

Each weight plate 8-1 . . . 8-8 has a generally round, disc-like body with an ideal thickness of ⅝ of an inch. However, the bottom of the weight plates 8-1 . . . 8-8 are preferably flat to facilitate their standing up side-by-side one another when the dumbbell 1 is laid down against a flat surface or is not in use at which time the weight plates can be separated from one another and stored in a rack. Additionally, the flat bottoms of the weight plates 8-1 . . . 8-8 provide the dumbbell 1 with stability that prevents it from rolling along the flat surface during exercises where the user grips the handle 3 and applies his body weight downward.

By way of example only, each of the identical weight plates 8-1 . . . 8-8 is ideally cast from metal so as to have a weight of either 2.5 pounds or 5.0 pounds. To establish their different weights, the weight plates 8-1 . . . 8-8 are cast with one or more filling cavities. In the example shown in FIGS. 1-3, each weight plate has two filling cavities 10 and 12 (best shown in FIG. 3) which extend completely through the body thereof. During their manufacture, the filling cavities 10 and 12 of some weight plates are filled with steel plugs 14 and 16. In this case, the weight plates with steel filled cavities 10 and 12 will have the heavier weight of 5.0 pounds. However, the filling cavities 10 and 12 of other weight plates are not filled and remain empty. In that case, the weight plates with empty cavities 10 and 12 will have the lighter weight of 2.5 pounds. Of course, the type of material and/or the density thereof that is loaded into the filling cavities can be changed to correspondingly change the weights of the weight plates without having to change their physical dimensions.

In the example of the dumbbell 1 shown in FIGS. 1-3, the first weight plate 8-1 and the last weight plate 8-8 of the plurality of weight plates 8-1 . . . 8-8 have steel plugs 14 and 16 loaded into their filling cavities 10 and 12 and, therefore, have a heavier weight of 5.0 pounds. Each of the other intermediate weight plates 8-2 . . . 8-7 of dumbbell 1 which are cast separately from the heavier 5.0 pound weight plates has empty filling cavities 10 and 12 and, therefore, has a lighter weight of 2.5 pounds. Accordingly, in the present example, the plurality of weight plates 8-1 . . . 8-8 of the dumbbell 1 shown in FIG. 3 have a gross weight of 25 pounds. The gripping handle 3 and the collars 5 and 7 attached thereto add an additional 5 pounds, so that the dumbbell 1 has a total weight of 30 pounds. However, as will be explained in greater detail hereinafter, the number of weight plates to be carried by the dumbbell 1 and the total weight represented thereby can be selectively adjusted and incrementalized to meet the needs of the individual during his weight lifting exercise.

FIGS. 4-8 of the drawings show the dumbbell 1 with all of the weight plates removed therefrom so that only the gripping handle 3 remains connected between the opposing collars 5 and 7. Each of the disc-like collars 5 and 7 has a (e.g., round) coupling cavity 18 (only one of which being shown in FIG. 4) formed in an inside face thereof. The coupling cavities 18 are sized and shaped to receive therewithin opposite ends of the cylindrical gripping handle 3. Each collar 5 and 7 also has a hole 20 extending axially therethrough to communicate with a coupling cavity 18. Likewise, each of the opposite ends of the handle 3 has a threaded opening 22 extending axially therealong.

The gripping handle 3 of the dumbbell 1 is detachably connected to and between the opposing collars 5 and 7 by locating the opposite ends of the handle 3 is respective coupling cavities 18 formed in the inside faces of collars 5 and 7 such that the holes 20 through the collars 5 and 7 and the threaded openings 22 formed in the handle 3 are axially aligned with one another. Threaded fasteners 24 are then pushed through the holes 20 and rotated into removable mating engagement with the axially aligned threaded openings 22 at opposite ends of the handle 3.

Each of the opposing collars 5 and 7 includes a tapered, generally V-shaped coupling body 26 projecting outwardly from and running diagonally along an outside face thereof. Each V-shaped coupling body 26 has a relatively wide head 28 that lies adjacent the outside edge of a corresponding one of the round collars 5 and 7 and a relatively narrow tail 30 that lies radially inward from the head 28. A guide rail 32 runs along each of the opposing sides of each of the outwardly projecting V-shaped coupling bodies 26.

An engagement pin extension channel 34 runs laterally across each V-shaped coupling body 26 so as to lie between the relatively wide head 28 and the relatively narrow tail 30 thereof. The aforementioned holes 20 that extend axially through each of the opposing collars 5 and 7 of the dumbbell 1 to receive respective threaded fasteners 24 therethrough also extend through the coupling bodies 26 which project from the outside faces of the collars. The advantage provided by the V-shaped coupling bodies 26 and the engagement pin extension channels 34 running laterally thereacross will soon be explained.

Figure 10:
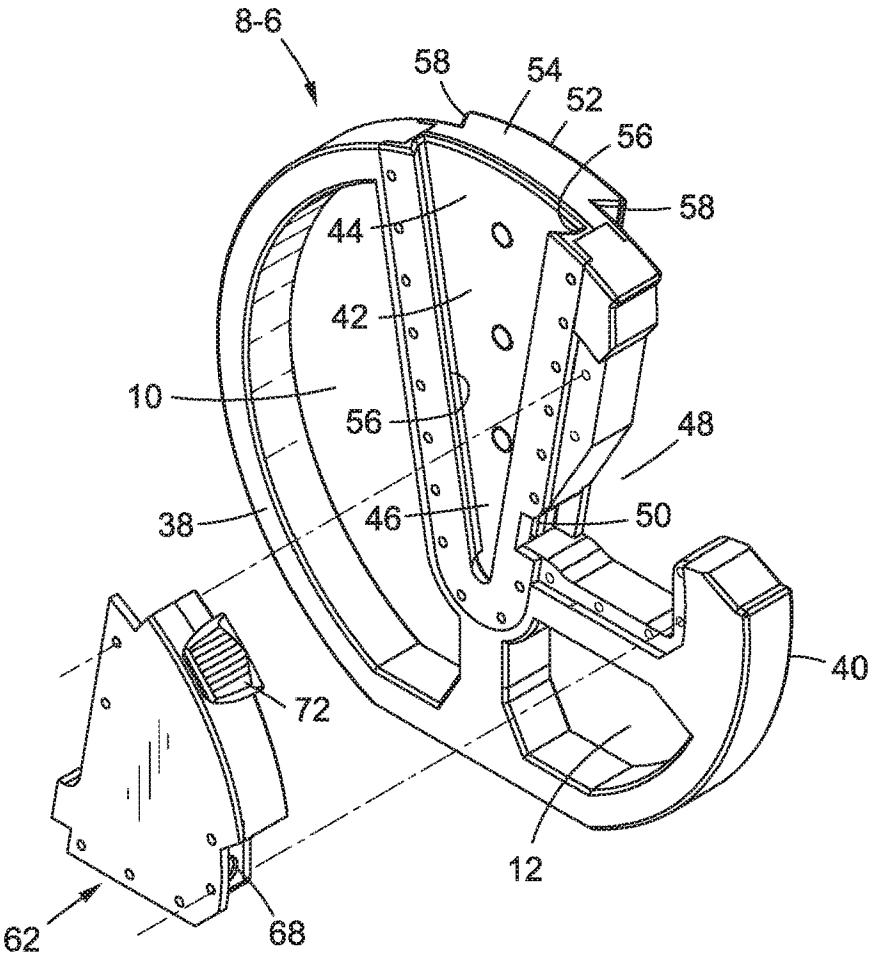
FIG. 10 is an exploded view showing the locking cartridge removed from the weight plate shown in FIG. 9.
Figure 9:
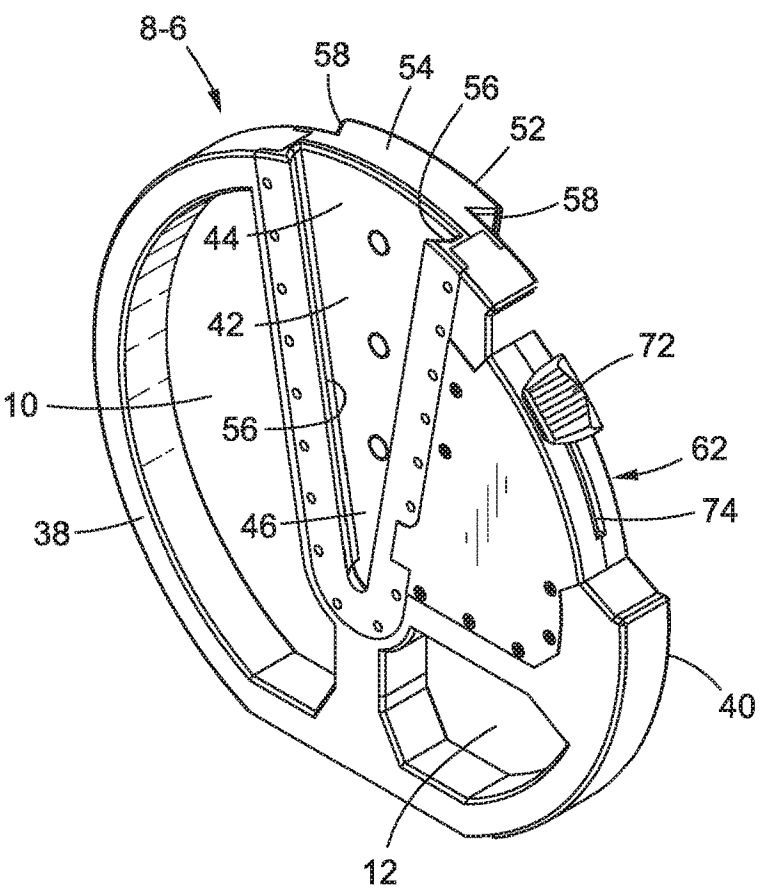
FIG. 9 shows a locking cartridge removably connected to one of the weight plates of the dumbbell shown in FIG. 3.

Details of the identical disc-like weight plates (designated 8-1 . . . 8-8 in FIG. 3) to be selectively and detachably connected to each other and to one or the other of the collars 5 and 7 at opposite ends of the gripping handle 3 of the dumbbell 1 are now described while referring to FIGS. 9 and 10 of the drawings. Each weight plate (e.g., 8-6) whether it is one that has steel plugs 14 and 16 located in its filling cavities 10 and 12, includes opposing inside and outside faces 38 and 40. A diagonally extending, tapered and generally V-shaped coupling slot 42 is recessed into the inside face 38 of each weight plate. Each V-shaped coupling slot 42 has a relatively wide head 44 that lies adjacent the outside edge of the round weight plate 8-6 and a relatively narrow tail 46 that lies radially inward from the head 44. A cartridge cavity 48 (best shown in FIG. 10) extends completely through the weight plate 8-6 between the inside and outside faces 38 and 40 thereof to receive a soon to be described locking cartridge 62 therewithin. A relatively narrow engagement pin receiving opening 50 (also best shown in FIG. 10) extends between the cartridge cavity 48 and the V-shaped coupling slot 42.

A diagonally extending, tapered and V-shaped coupling body 52 projects from the outside face 40 of weight plate 8-6 so as to lie opposite the coupling slot 42 that is recessed within the inside face 38. The V-shaped coupling body 52 of the weight plate 8-6 has a size and shape that match the size and shape of the opposing coupling slot 42 as well as the V-shaped coupling bodies 26 which project outwardly from the collars 5 and 7 that are connected to opposite ends of the gripping handle 3. Like the V-shaped coupling slot 42 at the inside face 38 of weight plate 8-6, the V-shaped coupling body 52 at the outside face 40 has a relatively wide head 54 that lies adjacent the outside edge of the round weight plate 8-6 and a relatively narrow tail (designated 55 in FIGS. 15 and 16) that lies radially inward from the head 54.

The recessed V-shaped coupling slots 42 and the outwardly projecting V-shaped coupling bodies 52 at opposite inside and outside faces 38 and 40 of each of the weight plates 8-1 . . . 8-8 of FIG. 3 are sized and shaped relative to each other so that the coupling body 52 at the outside face 40 of any one weight plate is slidably received by and mated to the coupling slot 42 at the inside face 38 of any other adjacent weight plate, whereby the weight plates are detachably connected face-to-face one another to be carried by the dumbbell 1. To facilitate the slidable connection and mating engagement of a coupling body 52 to a coupling slot 42 so that adjacent weight plates are held face-to-face, locking grooves 56 are formed along the opposite sides of each V-shaped coupling slot 42 within which to slidably receive and releasably capture respective guide rails 58 that run along opposite sides of each V-shaped coupling body 52. The slidable mating engagement of a coupling body 52 and the guide rails 58 thereof from one weight plate to a coupling slot 42 and the locking grooves 56 of an adjacent weight plate is commonly referred to as a dove-tail connection.

In this same regard, a pair of weight plates (e.g., designated 8-4 and 8-5 in FIGS. 1-3) from the aforementioned first and second sets thereof are detachably connected to respective ones of the collars 5 and 7 that are connected to opposite ends of the gripping handle 3. That is, the V-shaped coupling bodies 26 that project outwardly from the collars 5 and 7 are slideably and removably received by the V-shaped coupling slots 42 that are recessed into the inside faces 38 of weight plates 8-4 and 8-5. By virtue of the guide rails 32 that run along the sides of the coupling bodies 26 of the collars 5 and 7 and the locking grooves 56 that run along the sides of the coupling slots 42 of the weight plates 8-4 and 8-5, the coupling bodies 26 are coupled to the coupling slots 42 by means of an identical dove-tail connection as described above.

Referring to FIG. 11-14 of the drawings, details are provided of each locking cartridge 62 that is operable for causing a first weight plate (e.g., 8-6) being carried by the dumbbell 1 to be detachably and selectively connected to an additional weight plate (e.g., 8-7 of FIGS. 1-3) so that both weight plates can be carried together by the dumbbell along with any other newly added weight plates as is necessary to suit the exercise requirements of the user. The locking cartridge 62, the coupling slot 42, and the coupling body 52 are interconnected to each other and to the weight plate 8-6 by means of press-fit fasteners (not shown). The locking cartridge 62 of weight plate 8-6 and each of the other weight plates includes a (e.g., plastic) housing having opposing housing sections 64-1 and 64-2 and an elongated locking pin channel 66 that runs completely through the bottom of one of the housing sections 64-1 of the locking cartridge to communicate with an exit opening 68. A locking pin 70 is slidably received within the locking pin channel 66 and adapted to be pushed or pulled reciprocally through the channel between retracted and extended positions so as to be either moved towards or away from the exit opening 68 by which the first weight plate 8-6 is either connected to or disconnected from the additional weight plate 8-7.

Figure 14:
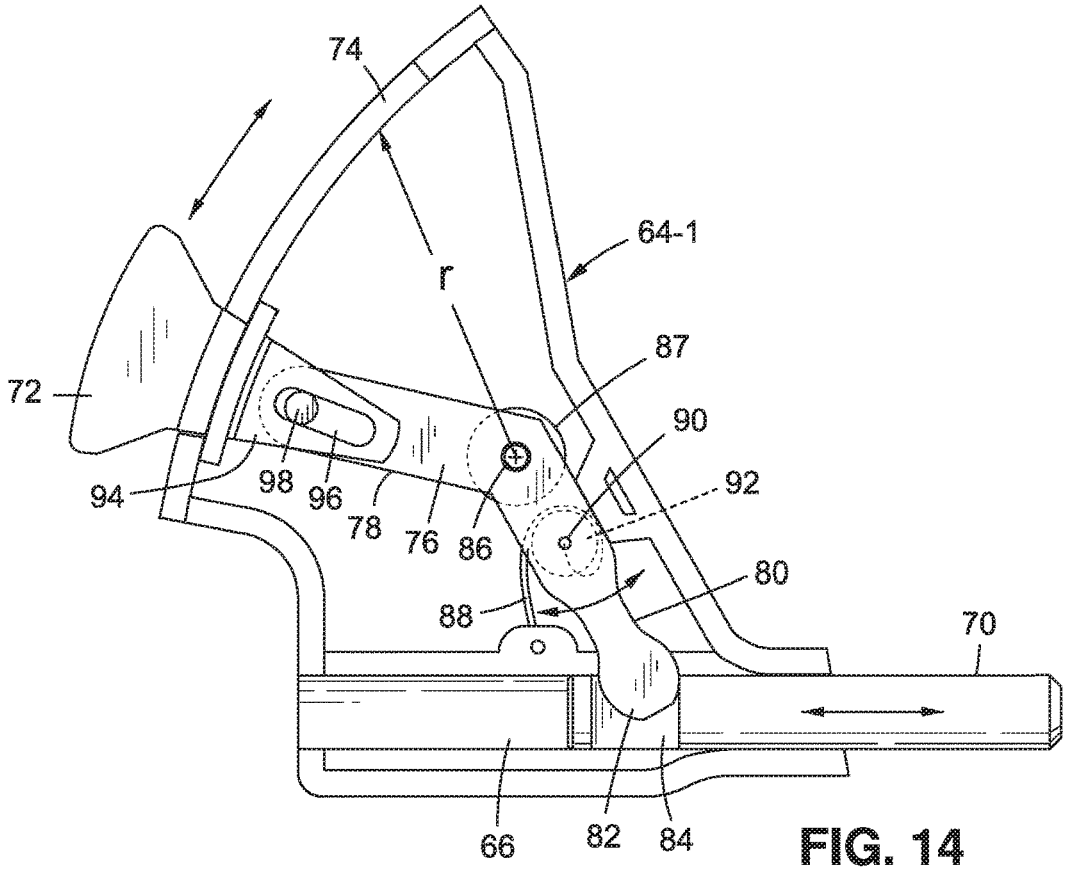
FIG. 14 shows the locking cartridge of FIG. 13 with the switch knob thereof being rotatable in opposite directions to cause a rotatable switch arm to which the switch knob is coupled to rotate and a locking pin to move back and forth through the locking cartridge between a retracted position and an extended position.

The reciprocal displacement of the locking pin 70 of locking cartridge 62 through locking pin channel 66 is controlled by a radiused switch knob 72 that is manually manipulated (i.e., rotated) in opposite directions represented by the reference arrows shown in FIG. 14 between unlocked and locked positions. The switch knob 72 is rotated through a guide slot 74 that is formed in the top of the locking cartridge 62 (best shown in FIG. 11). The switch knob 72 is interconnected with the locking pin 70 through guide slot 74 by way of a rotatable toggle lever switch arm 76 that is located within the locking cartridge 62 so that a rotational force applied to the switch knob 72 is translated by switch arm 76 into a linear displacement of the locking pin 70 through the locking pin channel 66.

The rotatable toggle lever switch arm 76 includes an upper arm portion 78 and a lower arm portion 80 that are coextensively joined to one another at an elbow and aligned to make an angle of about 135 degrees. One end of the upper arm portion 78 of toggle lever switch arm 76 is coupled to the switch knob 72. One end of the lower arm portion 80 of switch arm 76 includes a relatively wide switch head 82 that is located in and captured by a bore 84 that is formed near the outer end of the locking pin 70 (best shown in FIGS. 12 and 13), whereby a rotation of the switch knob 72 causes the switch head 82 to generate a pushing or pulling force for correspondingly causing the locking pin 70 to slide through the locking pin channel 66 between its retracted and extended positions. A stationary dowel pin 86 or similar fixed pivot is connected through the elbow at the intersection of the upper and lower arm portions 78 and 80 of the rotatable toggle lever switch arm 76 to a spacer 87 that stands upwardly from the housing section 64-1 of the locking cartridge 62 to establish a pivot axis around which switch arm 76 will rotate in response to a force applied by the user to rotate the switch knob 72 to one of its unlocked or locked positions. A (e.g., coil) spring 88, or the like, is connected from a pin hole 90 through the lower arm portion 80 of the toggle lever switch arm 76 to the housing section 64-1 of the locking cartridge 62 by way of a mounting hub 92 so as to urge the switch knob 72 and the switch arm 76 coupled thereto to automatically rotate to one of the locked or unlocked positions of the switch knob 72 in order to avoid an indefinite intermediate position.

An important feature by which the upper arm portion 78 of the rotatable toggle lever switch arm 76 is coupled to the switch knob 72 is a coupling tab 94 that depends from the switch knob 72. A vertically extending coupling slot 96 is formed through the coupling tab 94. The switch knob 72 is coupled to the rotatable switch arm 76 when one end of a coupling pin 98 (best shown in FIGS. 12 and 13) is received by a coupling hole 100 that is formed through the upper arm portion 78 of the switch arm 76 and the opposite end of the coupling pin 98 is received through the coupling slot 96 of coupling tab 94.

Figure 13:
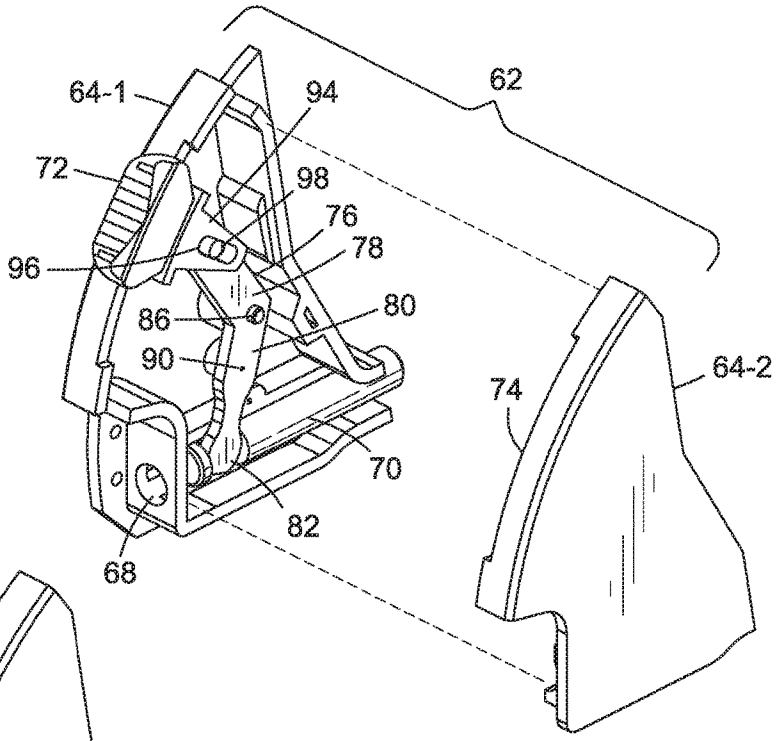
FIG. 13 is a partially exploded view of the locking cartridge of FIG. 10 with a pair of opposing housing sections separated from one another.
Figure 11:
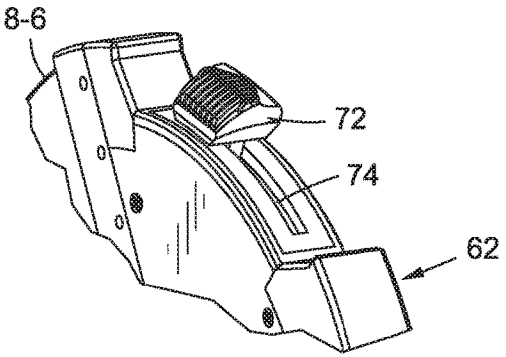
FIG. 11 shows a portion of the locking cartridge of FIG. 10 having a guide slot formed therein through which a rotatable switch knob is rotated.
Figure 12:
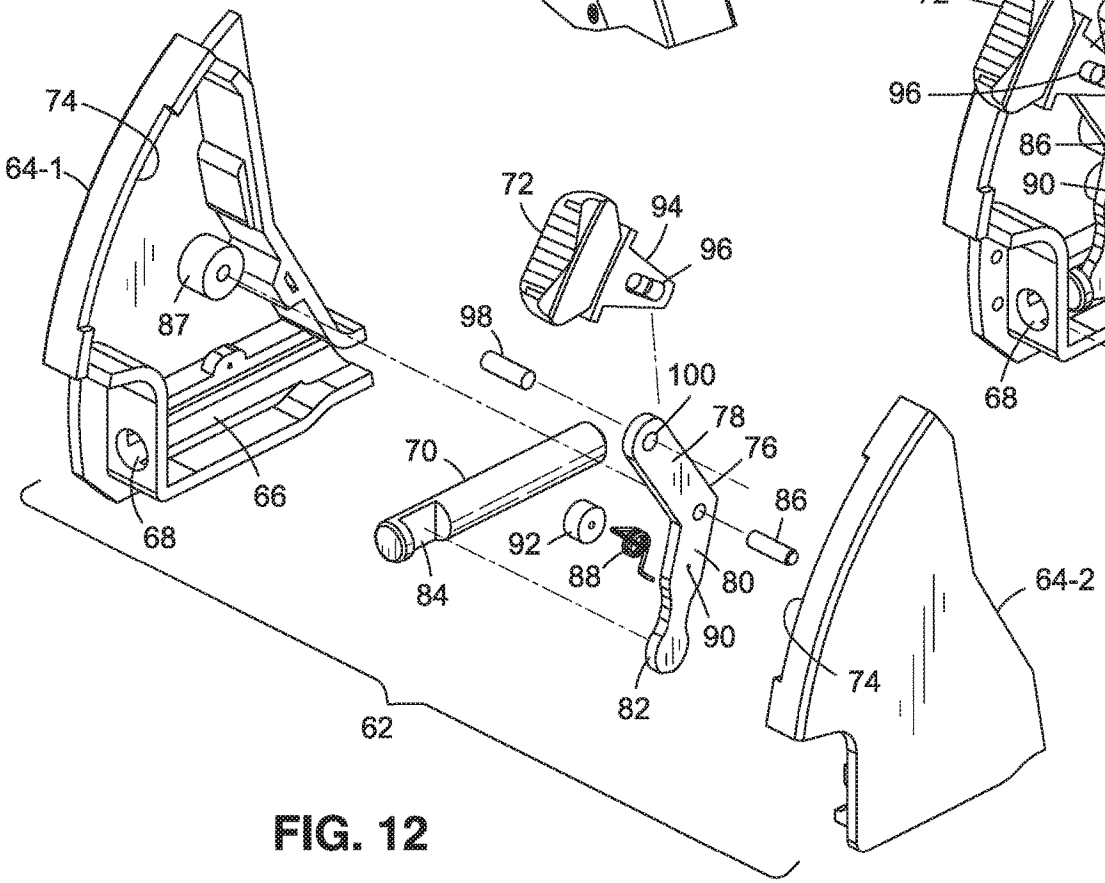
FIG. 12 is an exploded view of the locking cartridge of FIG. 10.

As is best shown in FIG. 13, the coupling tab 94 that depends from the switch knob 72 lies against and slides over the upper arm portion 78 of switch arm 76 as the switch knob is rotated back and forth through the guide slot 74 that runs along the top of the locking cartridge 62 shown in FIG. 11. As the switch knob 72 is rotated, the vertical coupling slot 96 that is formed through the coupling tab 94 is simultaneously moved up or down relative to the coupling pin 98 that is received through the coupling slot 96 depending upon the direction in which the switch knob 72 and the rotatable switch arm 76 are rotated.

Figure 15:
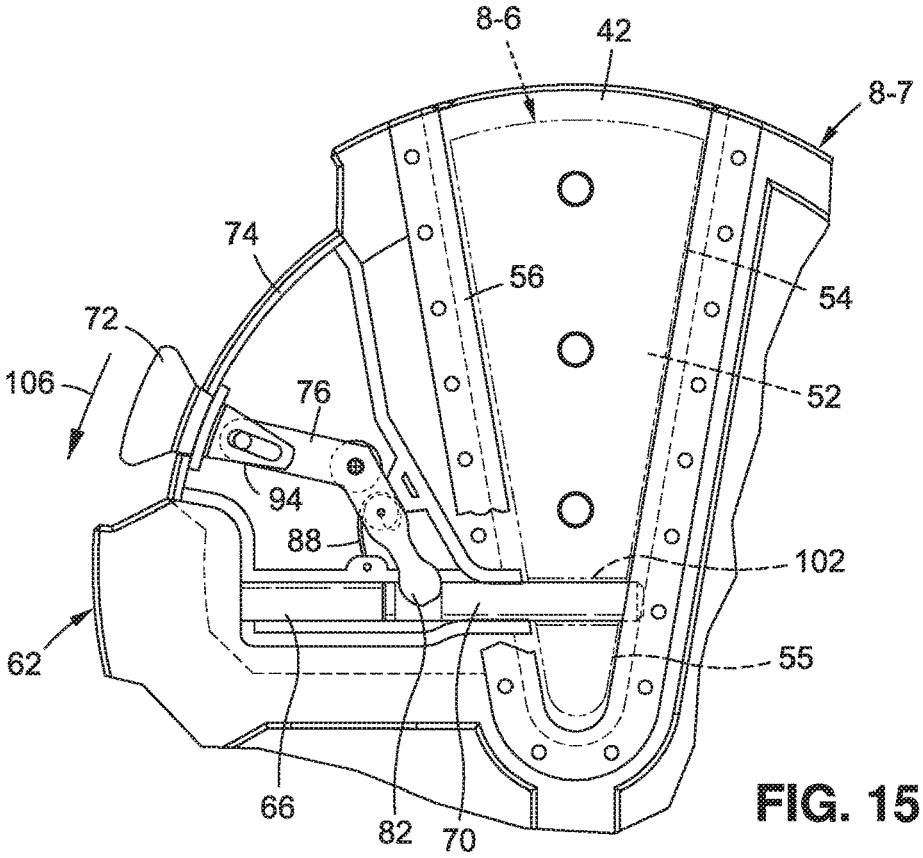
FIG. 15 shows the switch knob of the locking cartridge of FIG. 14 rotated in a first direction to a locked position, whereby the locking pin is pushed by the rotatable switch arm to its extended position so that an additional weight plate to which the locking cartridge is connected is detachably connected to an existing weight plate to increase the weight of the dumbbell.
Figure 16:
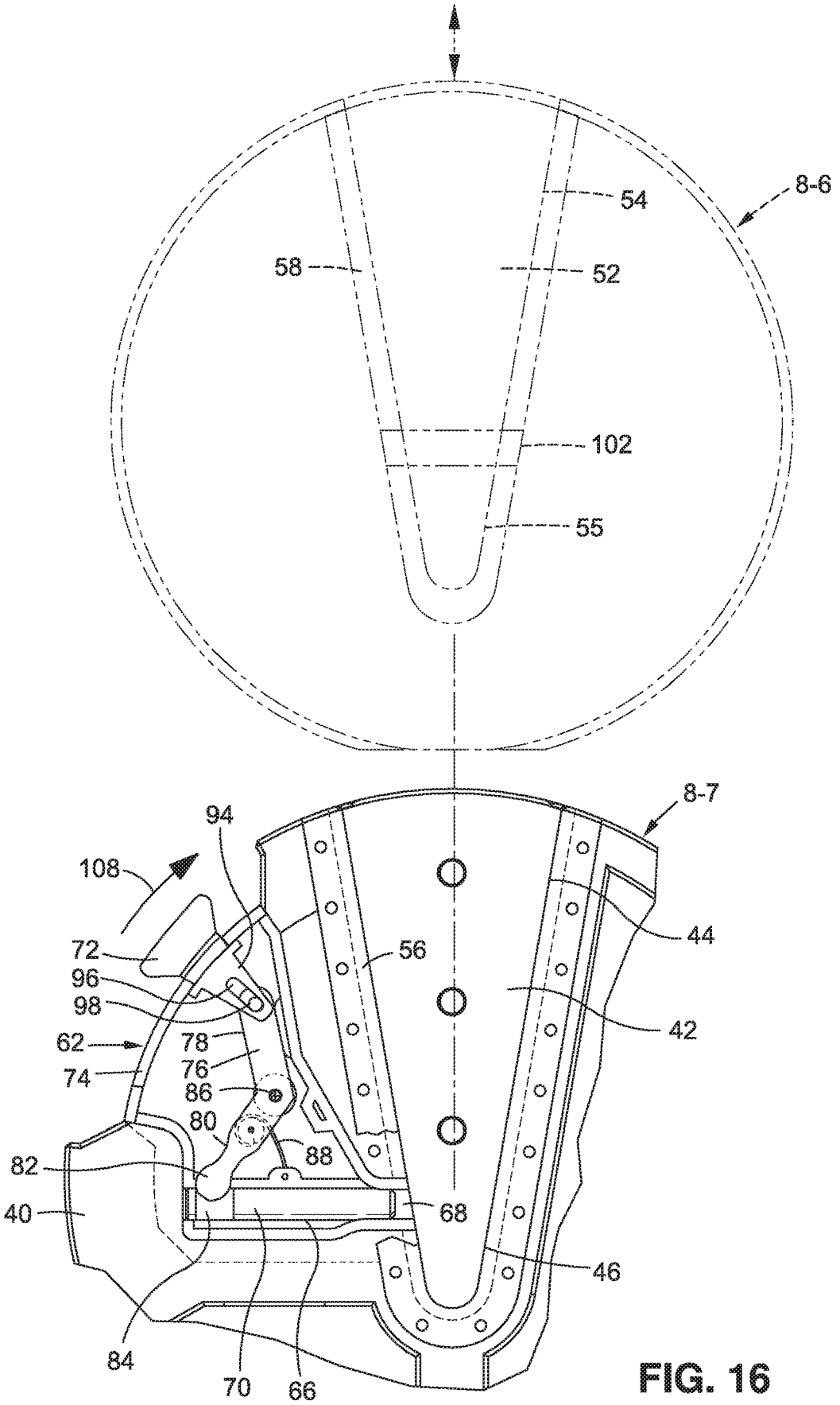
FIG. 16 shows the switch knob of the locking cartridge of FIG. 14 rotated in the opposite direction to an unlocked position, whereby the locking pin is pulled by the rotatable switch arm to its retracted position at which the additional and existing weight plates are disconnected from one another.

In operation, the switch knob 72 is rotated by the user in one of the first or opposite directions represented by the reference arrows shown in FIG. 14 between its aforementioned locked and unlocked positions. Referring specifically to FIGS. 14-16 of the drawings, when it is desirable to attach a first weight plate (e.g., 8-6) already being carried by the dumbbell 1 to an additional weight plate (e.g., 8-7) to increase the total weight of the dumbbell, the V-shaped coupling body 52 which projects from the outside face 40 of the first weight plate 8-6 is moved downwardly and into slidable receipt by the V-shaped coupling slot 42 that is recessed within the inside face 38 of the additional weight plate 8-7. Accordingly, the first and additional weight plates 8-6 and 8-7 will now be coupled adjacent to and face-to-face one another.

To cause the detachable connection of the first weight plates 8-6 to the additional weight plate 8-7, the switch knob 72 from the locking cartridge 62 of the additional weight plate 8-7 is rotated by a finger of the user in a counter-clockwise direction represented by the reference arrow 106 of FIG. 15 towards its locking position. The slidable locking pin 70 is correspondingly pushed by the rotatable toggle lever switch arm 76 axially through the locking pin channel 66 in the locking cartridge 62 of the additional weight plate 8-7 to its extended position extending outwardly from the locking cartridge 62 and through the locking pin receiving opening 50 (of FIG. 10) at which to engage the coupling body 52 of the first weight plate 8-6 that has been located in the coupling slot 42 of the additional weight plate 8-7.

The first and additional weight plates 8-6 and 8-7 are detachably connected face-to-face one another after the switch knob 72 of the locking cartridge of the additional weight plate 8-7 is rotated to its locked position and the locking pin 70 is pushed through the locking pin channel 66 and into an axially aligned coupling channel 102 (best shown in FIG. 16) that runs laterally through the coupling body 52 of the first weight plate 8-6 between the relatively wide head 54 at the top of coupling body 52 and the relatively narrow tail 55 at the opposite bottom end thereof.

Continuing to refer to FIGS. 14-16 and the steps by which the first weight plate 8-6 is connected face-to-face to the additional weight plate 8-7 when the switch knob 72 is rotated to its locked position shown in FIG. 15, the upper arm portion 78 of the rotatable toggle lever switch arm 76 is rotated by switch knob 72 around the stationary pivot pin 86 in a counter-clockwise direction through the locking cartridge 62 of the additional weight plate 8-7. The lower arm portion 80 of switch arm 76 which is interconnected to the locking pin 70 by the receipt of switch head 82 within the bore 84 of pin 70 rotates with the upper arm portion 78 around the pivot pin 86 so as to push the locking pin 70 through the locking pin channel 66 and into the axially aligned coupling channel 102 that runs laterally through the coupling body 52 of the first weight plate 8-6.

The receipt of the locking pin 70 from the locking cartridge 62 of the additional weight plate 8-7 by the coupling channel 102 of the coupling body 52 of the first weight plate 8-6 prevents an inadvertent removal of the coupling body 52 of the first weight plate 8-6 from the coupling slot 42 of the additional weight plate 8-7 whereby the first and additional weight plates will be lifted together by the dumbbell 1. By detachably connecting one or more additional weight plates to each other in the manner just described, the user is able to selectively and incrementally increase the gross weight of the dumbbell 1 according to his needs.

Should it be desirable to disconnect the first weight plate 8-6 from the additional weight plate 8-7 or disassemble the dumbbell 1, the switch knob 72 of the locking cartridge 62 of the additional weight plate 8-7 is pushed in a clockwise direction represented by the reference arrow 108 of FIG. 16. The locking pin 70 of the locking cartridge 62 of the additional weight plate 8-7 is correspondingly pulled to its retracted position inwardly of the locking cartridge by the switch head 78 of the rotating toggle lever switch arm 76. Accordingly, the locking pin 70 is now withdrawn from the coupling channel 102 in the coupling body 52 of the first weight plate 8-6 and pulled into the locking pin channel 66 of the locking cartridge 62 of the additional weight plate 8-7 to enable the coupling body 52 of the first weight plate 8-6 to be pulled upwardly relative to and removed from the coupling slot 42 of the additional weight plate 8-7.

It can be recognized that the switch knob 72 and the toggle lever switch arm 76 that rotate together around the stationary pivot pin 86 within the locking cartridge 62 perform the functions of a mechanical switch. That is to say, when the switch knob 72 is rotated between its unlocked (off) and locked (on) positions of FIGS. 16 and 15, the locking pin 70 of locking cartridge 62 is either pulled by the rotatable switch arm 76 to its retracted position and withdrawn from the coupling body 52 of the previously attached first weight plate 8-6 to permit the first weight plate to be disconnected from its adjacent additional weight plate 8-7 or pushed towards its extended position and coupled to the coupling body 52 of the first weight plate 8-6 by which to cause the first weight plate 8-6 and the additional weight plate 8-7 to be connected together face-to-face one another.

By virtue of the generally V-shaped coupling slot 42 recessed in one of the weight plates and the generally V-shaped coupling body 52 projecting from an additional weight plate, the narrow tail 55 of the coupling body 52 is automatically aligned with and guided by the wide head 44 of the coupling slot 42 to permit a substantially straight-in sliding receipt of the coupling body 52 by the coupling slot 42 (best shown in FIG. 16). Moreover, the V-shaped coupling slot 42 and coupling body 52 facilitate a quick and easy detachable connection of the first and additional weight plates to one another to reduce the frustration of the user that has often been experienced while adding additional weights to conventional dumbbells.

Likewise, when the first and the additional weight plates are disconnected from one another and the coupling body 52 of the first weight plate 8-6 is pulled upwardly relative to and out of the coupling slot 42 of the additional weight plate 8-7, the narrow tail 55 of the upwardly sliding coupling body 52 of the first weight plate must only be moved a short distance through the gradually widening coupling slot 42 of the additional weight plate. Because the progressively widening coupling slot 42 will soon become wider than the narrow tail 55 as the coupling body 52 moves upwardly through the coupling slot 42, the coupling body 52 of the first weight plate 8-6 can be simply pulled outwardly and removed from the coupling slot 42 of the additional weight plate 8-7 to thereby facilitate a quick and easy disconnection of the first and additional weight plates.

As another important feature of this invention, each switch knob 72 of each locking cartridge 62 rotates along a circular path that conforms to a portion of the circumference of each of the round, disc-like weight plates (e.g., designated 8-6 in FIGS. 9 and 10) as the switch knob is rotated by the user between its unlocked and locked positions and the switch arm 76 rotates around the stationary pivot pin 86. That is to say, the distance (designated by the reference line "r" in FIG. 14) between the stationary pivot pin 86 to which the elbow of the rotatable toggle lever switch arm 76 is pivotally connected and the switch knob 72 varies continuously as the switch knob is rotated around the outside of the weight plate 8-6 between its locked position shown in FIG. 15 and its unlocked position shown in FIG. 16.

The foregoing variable distance "r" is achieved when the coupling tab 94 that depends from the switch knob 72 slides vertically up or down over and against the upper arm portion 78 of the toggle lever switch arm 76 at the same time that the switch arm is rotated back and forth as the switch knob 72 moves in one of the opposite directions along the guide slot 74 atop the locking cartridge 62 as indicated by the reference arrows shown in FIG. 14. In particular, when the switch knob 72 is rotated in a counterclockwise direction represented by the reference arrow 106 of FIG. 15, the coupling tab 94 slides downwardly over the upper arm portion 78 of the rotatable switch arm 76. The vertical coupling slot 96 formed in the coupling tab 94 moves with the coupling tab downwardly relative to the coupling pin 98 that is received through the coupling slot 96. In this case, the distance between the switch knob 72 and the stationary pivot pin 86 is continuously reduced.

However, when the switch knob 72 is rotated along the guide slot 74 of locking cartridge 62 in the opposite clockwise direction represented by the reference arrow 108 of FIG. 16, the coupling tab 94 slides upwardly over and against the upper arm portion 78 of the rotatable switch arm 76. Accordingly, the vertical coupling slot 96 that is formed in coupling tab 94 moves upwardly relative to the coupling pin 98. In this case, the distance between the switch knob 72 and the stationary pivot pin 86 is continuously increased.

The ability to vary the distance "r" between the stationary pivot pin 86 extending through the rotatable toggle lever switch arm 76 and the switch knob 72 as the switch arm rotates around the pivot pin 86 enables the switch knob 72 to travel back and forth through the guide slot 74 formed in the locking cartridge 62 and move along a path that conforms to the arc of a circle and coincides with the circumference of the round weight plate 8-7. By virtue of the foregoing, the user's finger will be better able to fully engage and distinguish the radiused switch knob 72 from the locking cartridge 62 of one weight plate from the switch knob of an adjacent weight plate. At the same time, the user's finger will remain in contact with the switch knob 72 to ensure that it is completely rotated to one of its unlocked or locked positions, whereby the locking pin 70 is correspondingly and completely pulled or pushed by means of the rotatable toggle lever switch arm 76 to one of its retracted or extended positions. In this manner, a reliable connection or disconnection of one weight plate to or from another can be advantageously achieved.

The invention claimed is:

1. A weight training device comprising a gripping handle at which said weight training device is lifted and a plurality of weight plates interconnected with said gripping handle and detachably connected to one another, each of said plurality of weight plates having an outside edge, first and opposite faces, a coupling slot located at said first face, and a coupling body located at said opposite face, the coupling body of a first of said plurality of weight plates being removably received within the coupling slot of a second of said plurality of weight plates, whereby said first and second weight plates are detachably connected to one another, and wherein the coupling slot and the coupling body of each of said first and second weight plates has a wide top lying adjacent the respective outside edges of said first and second weight plates and a narrow bottom lying opposite and spaced from said wide top, each of said first and second weight plates having a housing including a locking pin moving therethrough between a retracted position located inwardly of said housing and an extended position extending outwardly from said housing, each housing of each of said first and second weight plates also including a switch knob and a rotatable switch arm pivotally connected to said respective housing and communicating with said switch knob so that said switch knob is coupled to said locking pin by way of said rotatable switch arm, such that a force applied to the switch knob of the housing of said second weight plate causes said rotatable switch arm to rotate and said locking pin to be moved by said rotatable switch arm to said extended position relative to the housing of said second weight plate and into each of the coupling slot of said second weight plate and the coupling body of said first weight plate, so that said first and second weight plates are detachably connected to one another, said rotatable switch arm being pivotally connected to the housing of the second weight plate by a stationary pivot extending between said rotatable switch arm and said housing, said switch knob having a coupling tab depending therefrom and being coupled to the rotatable switch arm of the housing of said second weight plate, said coupling tab having a coupling slot formed therein, and a coupling pin having a first end connected to said rotatable switch arm and an opposite end received through the coupling slot of said coupling tab, the coupling tab of said switch knob sliding over and along said switch arm and moving relative to the coupling pin received through said coupling slot as said switch knob is rotated relative to said second weight plate so that the distance between said stationary pivot and said switch knob varies continuously as said switch knob is rotated relative to said second weight plate.

2. The weight training device recited in claim 1, wherein each coupling slot and each coupling body of each of said first and second weight plates has a V-shape.

3. The weight training device recited in claim 2, wherein the coupling slot of each of said first and second weight plates has a pair of sides lying opposite one another and a groove extending along each of said pair of sides, and the V-shaped coupling body of each of said first and second weight plates has a pair of sides lying opposite one another and a guide rail extending along each of said pair of sides, the guide rails at the pair of sides of the coupling body of said first weight plate being received within and sliding along the grooves at the pair of sides of the coupling slot of said second weight plate, whereby said guide rails and said grooves are coupled to one another to establish a dove-tail connection therebetween.

4. The weight training device recited in claim 1, wherein each coupling slot and each coupling body of each of said first and second weight plates has a width which decreases continuously from the wide top thereof to the narrow bottom.

5. The weight training device recited in claim 1, wherein said first and second weight plates are detachably connected together so as to lie face-to-face one another when the coupling body of said first weight plate is removably received by the coupling slot of said second weight plate.

6. The weight training device recited in claim 1, wherein said first and second weight plates have different weights.

7. The weight training device recited in claim 1, wherein one of said first or second weight plates has at least one filling cavity formed therein that is empty and the other one of said first or second weight plates has at least one filling cavity formed therein that is filled with a material, whereby the other one of said weight plates is heavier than the one of said weight plates.

8. The weight training device recited in claim 1, wherein the outside of edge of each of said first and second weight plates is round, such that the coupling slot and the coupling body at the first and opposite faces of each of said first and second weight plates extend diagonally, and the wide tops of said coupling slots and said coupling bodies lie at the round outside edges of respective ones of said first and second weight plates, and the narrow bottoms of said coupling slots and said coupling bodies lie radially inward from said wide tops.

9. A weight training device comprising a gripping handle at which said weight training device is lifted, a first weight plate coupled to said gripping handle, and at least one additional weight plate to be coupled to said first weight plate, said additional weight plate having an outer edge, a portion of which is round, and a lock including a locking pin moving between retracted and extended positions relative to said at least one additional weight plate such that said locking pin is moved to the extended position at which to engage said first weight plate, whereby said at least one additional weight plate is detachably connected to said first weight plate, and said locking pin being moved to the retracted position at which to be disengaged from said first weight plate, whereby said at least one additional weight plate is disconnected from said first weight plate, the lock of said at least one additional weight plate further including a position control knob communicating with said locking pin, said position control knob receiving a force by which to rotate relative to said at least one additional weight plate and thereby cause said locking pin to move to one of said retracted or extended positions depending upon the direction of the force received by said position control knob, said position control knob rotating along a path that coincides with the round portion of the outer edge of said at least one additional weight plate, and said lock also including a lock housing attached to said at least one additional weight plate, said locking pin being movable through said lock housing between said retracted and extended positions, said lock further including a rotatable switch arm lying within said lock housing and extending between said position control knob and said locking pin such that the force received by said position control knob causes said rotatable switch arm to rotate and said locking din to be correspondingly moved between said retracted and extended positions, said rotatable switch arm being pivotally connected to the lock housing of said lock by a stationary pivot extending between said rotatable switch arm and said lock housing, such that the distance between said stationary pivot and said position control knob varies continuously as said position control knob is rotated relative to said at least one additional weight plate in response to the force received by said position control knob.

10. The weight training device recited in claim 9, wherein said position control knob has a coupling tab depending therefrom and being coupled to the rotatable switch arm of the lock of said at least one additional weight plate by which said rotatable switch arm and said position control knob communicate with one another, said coupling tab lying against and sliding over said rotatable switch arm in response to a rotation of said position control knob, whereby the distance between said stationary pivot and said position control knob varies continuously as said position control knob rotates relative to said at least one additional weight plate.

11. The weight training device recited in claim 10, wherein there is a coupling slot formed in the coupling tab depending from said position control knob and a coupling pin having a first end connected to said rotatable switch arm and an opposite end received through the coupling slot of said coupling tab, the coupling tab of said position control knob sliding over and along said rotatable switch arm and moving relative to the coupling pin received through said coupling slot as said position control knob rotates relative to said at least one additional weight plate so that the distance between said stationary pivot and said position control knob varies continuously.

12. The weight training device recited in claim 9, wherein said first weight plate has a coupling channel formed therein, the locking pin of said lock of said at least one additional weight plate moving to the extended position at which to be removably received within the coupling channel of said first weight plate, whereby said first weight plate and said at least one additional weight plate are detachably connected together.

* * * * *